United States Patent [19]

Paulson et al.

[11] 4,254,945

[45] Mar. 10, 1981

[54] FIXTURE FOR HANGING LARGE PANELS

[76] Inventors: Leland E. Paulson, 8528 Great Plains Blvd., Chanhassen, Minn. 55317; Peter J. Smith, 20075 Italy Ave., Lakeville, Minn. 55044

[21] Appl. No.: 142,466

[22] Filed: Apr. 21, 1980

[51] Int. Cl.[3] ..... B23Q 3/00

[52] U.S. Cl. ..... 269/102; 269/904

[58] Field of Search ..... 269/102, 289 R, 321 S; 145/1 A, 1 B; 33/174 G, 187, 188; 248/222.4, 225.1, 223.2, 225.2, 497, 498; 52/547, 543, 551, 556, 125, 105, 748

[56] References Cited

U.S. PATENT DOCUMENTS

| | | | |
|---|---|---|---|
| 1,835,042 | 12/1931 | Hammer | 248/498 |
| 2,108,196 | 2/1938 | Davis | 248/222.4 |
| 2,794,261 | 6/1957 | Fudge | 33/188 |
| 4,015,391 | 4/1977 | Epstein et al. | 52/543 |

FOREIGN PATENT DOCUMENTS

| | | | |
|---|---|---|---|
| 941688 | 4/1956 | Fed. Rep. of Germany | 248/222.4 |

*Primary Examiner*—Robert C. Watson
*Attorney, Agent, or Firm*—Paul L. Sjoquist

[57] ABSTRACT

A fixture for use in hanging large panels of the type typically found in construction projects, the fixture including an elongated shelf or tray which may be horizontally aligned on the construction project and fastened to vertical studs by nails which are selectively positioned in channels along a vertical side wall of the fixture and in the shape of inverted "T's" or "L's". After the fixture has been used to align, support and fasten large panels to the vertical structure the fixture may be conveniently removed from its supporting position.

10 Claims, 3 Drawing Figures

FIXTURE FOR HANGING LARGE PANELS

BACKGROUND OF THE INVENTION

This invention relates to fixtures for supporting large panels, and more particularly for fixtures used as an aid in construction projects for temporarily supporting large panels and/or construction sheets while the same are being positioned for attachment to the structure.

Various jigs and fixtures have been used in the prior art for aligning and attaching construction material to vertical side walls. For example, U.S. Pat. No. 3,792,852, issued Feb. 19, 1974 discloses a device for use as an automatic guide in laying shingles, shakes, clapboard and the like in parallel rows on the surfaces of various types of housings, buildings and other structures. This device provides a horizontal alignment tool by registering parallel rows of construction material relative to one another and providing for adjustable spacing of such rows.

Similarly, U.S. Pat. No. 4,089,141, issued May 16, 1978 discloses a tool which is temporarily attached to a side wall structure, and which has a horizontal projection from a lower portion so that siding can be supported on the projection while it is being nailed to the wall structure. Since the tool fastening arm extends above the siding being attached to the wall structure the fasteners, which are typically nails, can be subsequently removed and the tool can be withdrawn from its support position.

U.S. Pat. No. 4,164,346, issued Aug. 14, 1979, discloses a lap siding tool for registering adjacent siding sections in parallel and spaced relationship, which tool may be slid away from engagement after the siding section has been attached. All of the foregoing devices have similarity in that they relate to the attachment of construction material which is typically relatively long and narrow and consequently somewhat difficult to handle unless by more than one workman.

U.S. Pat. No. 4,158,455, issued June 19, 1979, discloses a wall panel installation jig for holding panel sections in position during installation. This device includes a channel section which is nailed temporarily to wall studs beneath the panel position. The panel is then placed in a channel section of the jig and inclined against the wall structure for temporary attachment, and then the nails holding the jig to the wall studs are removed to enable removal of the jig.

The prior art tools, jigs and fixtures suffer from a number of disadvantages. In some cases they are useful for attaching only relatively narrow shingles or siding construction materials, for the tool must be attached to the wall support structure at a point above the top edge of the siding. The tool must therefore be elongated so as to project above the siding, or the siding must be sufficiently narrow to permit the tool attachment point to project above the top edge of the siding. Other panel installation jigs are typically attached to wall studs beneath the panel mounting position, leaving exposed nail holes when the jig is removed. Such jigs also suffer from the disadvantage that they do not permit the attachment of a panel whereby the panel may project below the attachment point of the jig. This is particularly disadvantageous in construction wherein it is desired to have a large panel overlap a foundation or masonry structure while being supported against wall studs mounted atop such structure.

SUMMARY OF THE INVENTION

The wall panel installation fixture of this invention provides a device for temporarily holding wall panels and other sheet construction materials during installation. The device includes an elongated channel section which may be properly horizontally aligned and positioned relative to the wall structure, having a vertical side wall for positioning against the wall structure. A plurality of inverted T-shaped slots are provided in the vertical side wall, typically at spaced intervals corresponding to conventional wall stud spacing, whereby nails or other fasteners may be driven into the wall studs through the horizontal slot sections forming a part of the inverted T-shaped or L-shaped slots. The wall panel or the like may then be rested in the elongated channel and positioned for attachment to the wall structure, and after attachment of the panel the invention may be readily removed from the wall structure by merely sliding it sideways until the vertical slot opening permits the device to fall free from the nail fasteners.

In a preferred embodiment of the invention the fixture is made long enough to support more than one wall panel or the like of conventional construction size, there being sufficient additional length to permit such sidewise motion as described hereinbefore for removal of the fixture.

It is therefore a principal object of the present invention to provide a fixture for hanging large panels for construction installation whereby the device may be readily removed and reused after such panels have been installed.

It is another object of the present invention to provide a panel hanging fixture which permits wall panels to be hung at elevations lower than the attachment point of the fixture itself.

It is a further object of the present invention to provide a fixture for hanging large panels in lapped position relative to masonry of foundation structure.

These and other objects, features and advantages of the invention will become apparent from the following description of the preferred embodiment, particularly with reference to the accompanying drawings.

DESCRIPTION OF THE PREFERRED EMBODIMENT

Figure 1:
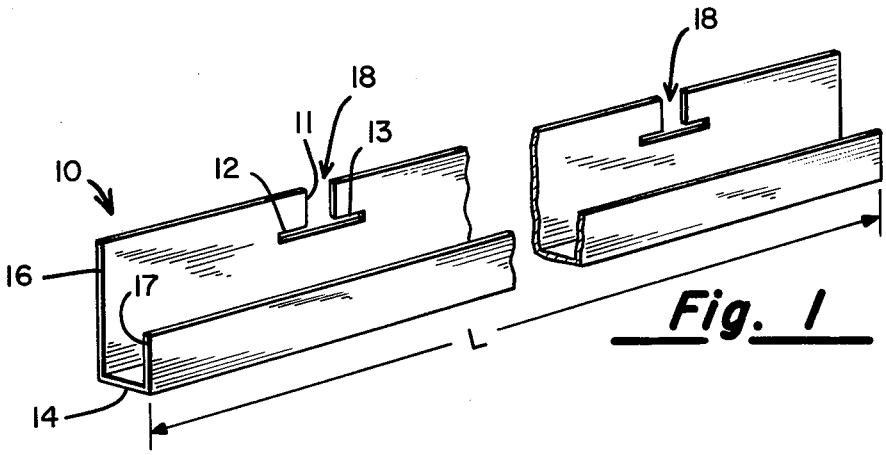
FIG. 1 is an isometric view of the invention, wherein portions of the elongated section of the invention have been removed for clarity.
Figure 2:
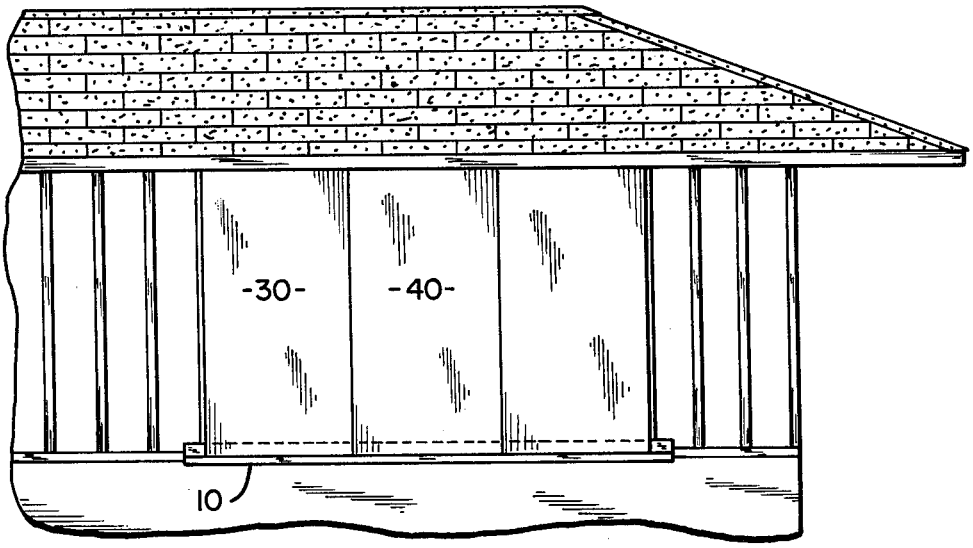
FIG. 2 is an elevation view of a construction wherein the invention is utilized.

Referring first to FIG. 1 there is shown in isometric view two sections of the present invention. The invention may be made of any convenient length L, it being preferred that the overall length L be at least longer than the width of several conventional panels of the type commonly used in construction. For example, the fixture may usefully be constructed in length longer than 12 feet, where it may be used to handle 48-inch wide panels in groups of two or three as is shown in FIG. 2. The fixture 10 has a front lip 17 which projects a short vertical distance above a lower horizontal channel 14. A rear side wall 16 projects vertically a greater distance than the height of front lip 17. Spaced along side wall 16 are a plurality of slots 18. These slots 18 may be positioned at 16-inch intervals, 24-inch intervals, or any other convenient spacing corresponding to conventional stud spacing as utilized in the construction industry. Alternatively, slots 18 may be repeated at intervals such as six-inch spacing, to form a more generalized fixture for a wide variety of construction applications. Length L is always made longer by at least several inches than the width of the panel or panels which are to be attached to the structure by use of the fixture.

Each of the slots 18 comprise an inverted "T" configuration, having a vertical slot section 11 opening through the upper edge of side wall 16, and at least one horizontal slot section 12, but preferably two horizontal sections 12 and 13, opening into vertical slot section 11 and extending a short distance along side wall 16. The respective widths of slot sections 12 and 13 should be at least large enough to accommodate the diameter of a nail attached therethrough, as for example a typical roofing or shingle nail, but less than the diameter of the corresponding nail head.

Alternatively, the slots 18 may each comprise an inverted "L" configuration, having a vertical slot section and a single horizontal slot section. In this case all of the horizontal slot sections in the respective slots 18 should relatively be cut in the same direction.

FIG. 2 shows fixture 10 in a typical preferred attachment position, for enabling the hanging and fastening of panel sections such as sections 30 and 40. Fixture 10 is preferably attached along a horizontal position against the vertical studs, the position of channel 14 corresponding to the desired height of the lower edges of the panel sections.

Figure 3:
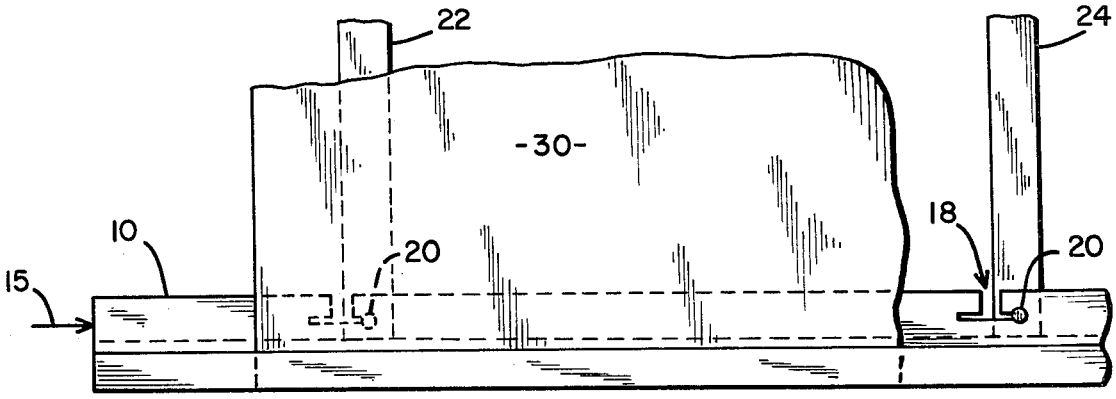
FIG. 3 is an expanded view of a portion of FIG. 2.

FIG. 3 shows an expanded view of a portion of FIG. 2, wherein fixture 10 is attached by means of nails 20 to vertical studs 22 and 24. Nails 20 are positioned respectively in the right-hand horizontal slot sections of slots 18, although they may be also respectively positioned in the left-hand horizontal slot sections of slots 18, so long as all nails are relatively placed in the same right-hand or left-hand slot section. After the fixture has been attached as shown, the panel sections are aligned and positioned relative to the vertical studs and attached thereto by nails. After the panel sections have been attached sufficiently to hold them to the wall structure, fixture 10 may be removed from its attached position by moving it in the direction of arrow 15, which movement may be accomplished by a sliding motion or tapping with a hammer or other tool.

In operation and use the fixture is attached as has been hereinbefore described to the vertical wall structure. It is positioned so as to provide some overhang beyond the panel sections which are subsequently attached to the wall structure. After the fixture has been attached the respective panel sections are placed into channel 14 and horizontally aligned against the vertical studs of the structure. The panel sections are fastened to the structure at least securely enough to hold them in position and fixture 10 is removed from attachment to the wall structure by sidewise motion either to the right or to the left. Depending upon the placement of nails 20 in the respective slot section. After fixture 10 has been removed, attachment of the panel sections may be completed, and nails 20 may be driven flush with the studs in which they are attached by tapping the exterior surface of the panel section over the nail location. The fixture may then be repositioned and reattached to the wall structure for subsequent panel installation.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. Apparatus for supporting and assisting in the attachment of large panels, comprising an elongated channel member having a raised front lip and a higher raised rear side wall, said side wall having a plurality of slots in the shape of inverted T's spaced along its top edge.

2. The apparatus of claim 1, wherein the length of said elongated channel member is longer than an integer multiple of the panel width.

3. The apparatus of claim 2, wherein each of said plurality of slots has a vertical slot section which is wider than corresponding horizontal slot sections.

4. The apparatus of claim 3, wherein the spacing of said slots along the top edge of said rear side wall is at regular intervals.

5. The apparatus of claim 4, wherein said elongated channel member is constructed from sheet steel material.

6. Apparatus for supporting and assisting in the attachment of large panels, comprising an elongated channel member having a raised front lip and a higher raised rear side wall, said side wall having a plurality of slots spaced along its top edge, said slots each having a vertical section opening to said top edge and a substantially horizontal section opening to said vertical section.

7. The apparatus of claim 6, wherein said vertical slot section is wider than said horizontal slot section.

8. The apparatus of claim 7, wherein the length of said elongated channel member is longer than an integer multiple of the panel width.

9. The apparatus of claim 8, wherein the spacing of said slots along the top edge of said rear side wall is at regular intervals.

10. The apparatus of claim 9, wherein said elongated channel member is constructed from sheet steel material.

* * * * *